US005291700A

United States Patent [19]

Chew

[11] Patent Number: 5,291,700

[45] Date of Patent: Mar. 8, 1994

[54] ACTIVITIES MODULE

[76] Inventor: Keith Chew, 3781 Unita St., Denver, Colo. 80237

[21] Appl. No.: 788,422

[22] Filed: Nov. 6, 1991

[51] Int. Cl.[5] ..... A47B 47/04; A47B 96/04; A47D 3/00; A47D 5/04

[52] U.S. Cl. ..... 52/36.1; 52/36.4; 52/36.5; 52/79.5; 52/286; 160/135; 160/351; 312/108; 312/195; 211/27; 211/36; 211/186

[58] Field of Search ..... 52/36, 35, 40, 79.5, 52/239, 236.1, 284, 286, 272, 281, 36.1, 36.4, 36.5; 160/135, 351; 312/107, 108, 195; 211/27, 36, 134, 186, 189, 196

[56] References Cited

U.S. PATENT DOCUMENTS

| | | | |
|---|---|---|---|
| 2,036,184 | 4/1936 | Armstrong | 211/134 X |
| 2,971,651 | 2/1961 | Shoffner | 211/134 X |
| 3,486,287 | 12/1969 | Guillon | 52/239 |
| 3,559,352 | 2/1971 | Magnuson | 52/281 |
| 3,565,152 | 2/1971 | Cohn | 160/351 X |
| 4,372,086 | 2/1983 | Hanlon | 52/36 |
| 4,434,900 | 3/1984 | Cook | 211/189 |
| 4,974,914 | 12/1990 | Bussard | 312/236 |
| 4,986,330 | 1/1991 | McGonagle | 160/135 |

*Primary Examiner*—Carl D. Friedman
*Assistant Examiner*—Robert Canfield
*Attorney, Agent, or Firm*—Timothy J. Martin; Dana S. Rewoldt

[57] ABSTRACT

An activities module is positioned on a support surface, such as the floor of a room, to provide activity stations with horizontal work surfaces. The module includes an upright post member that has at least two vertical grooves. A flat panel has an opening sized to receive the post member when the flat panel is oriented horizontally, and upright partition panels are provided corresponding to the vertical grooves in the post member. Each partition panel has an inner edge fitted into the groove, an outer edge and a bottom edge that rests on the support surface. The partition panels each have a slot to receive the flat, horizontal panel, and fasteners secure the module together. A second flat, horizontal panel may similarly be mounted below the first flat panel, and a third flat, horizontal panel may provide a shelf or bench. Preferably, the first flat panel is circular and the upright post is located centrally thereof; four partition panels are spaced around the center post to divide the module into four activity stations.

23 Claims, 8 Drawing Sheets

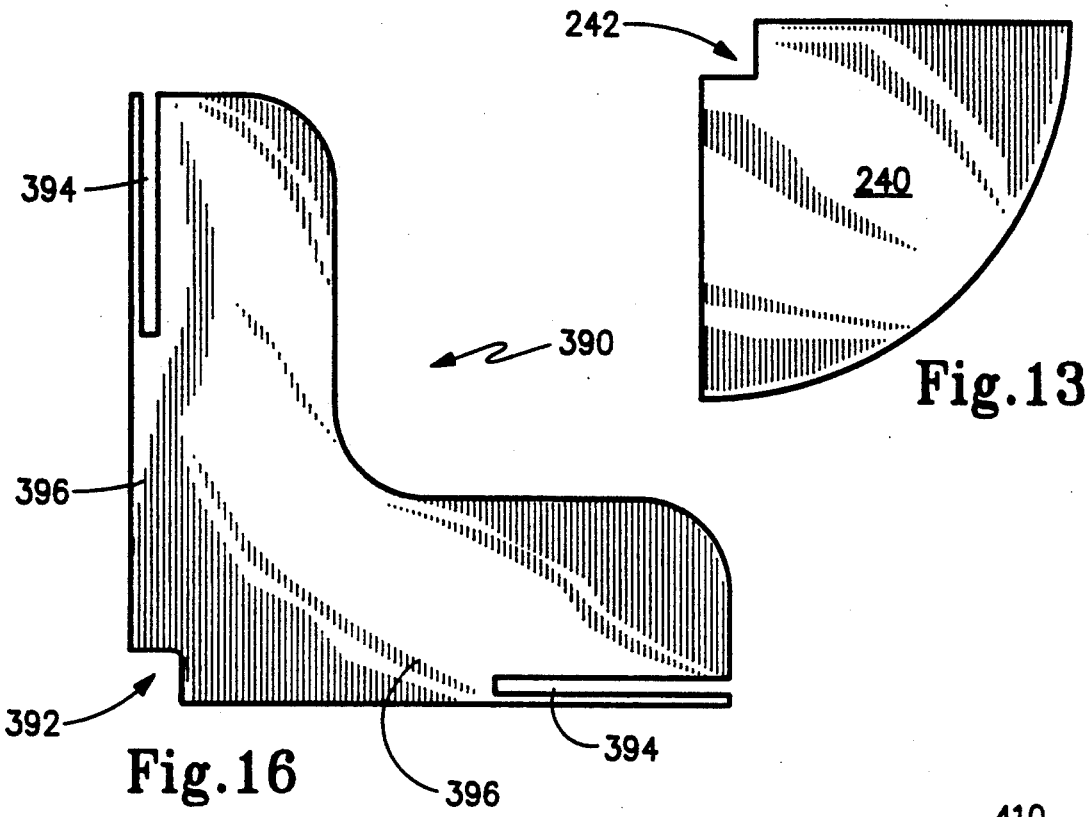
Fig.13
Fig.16
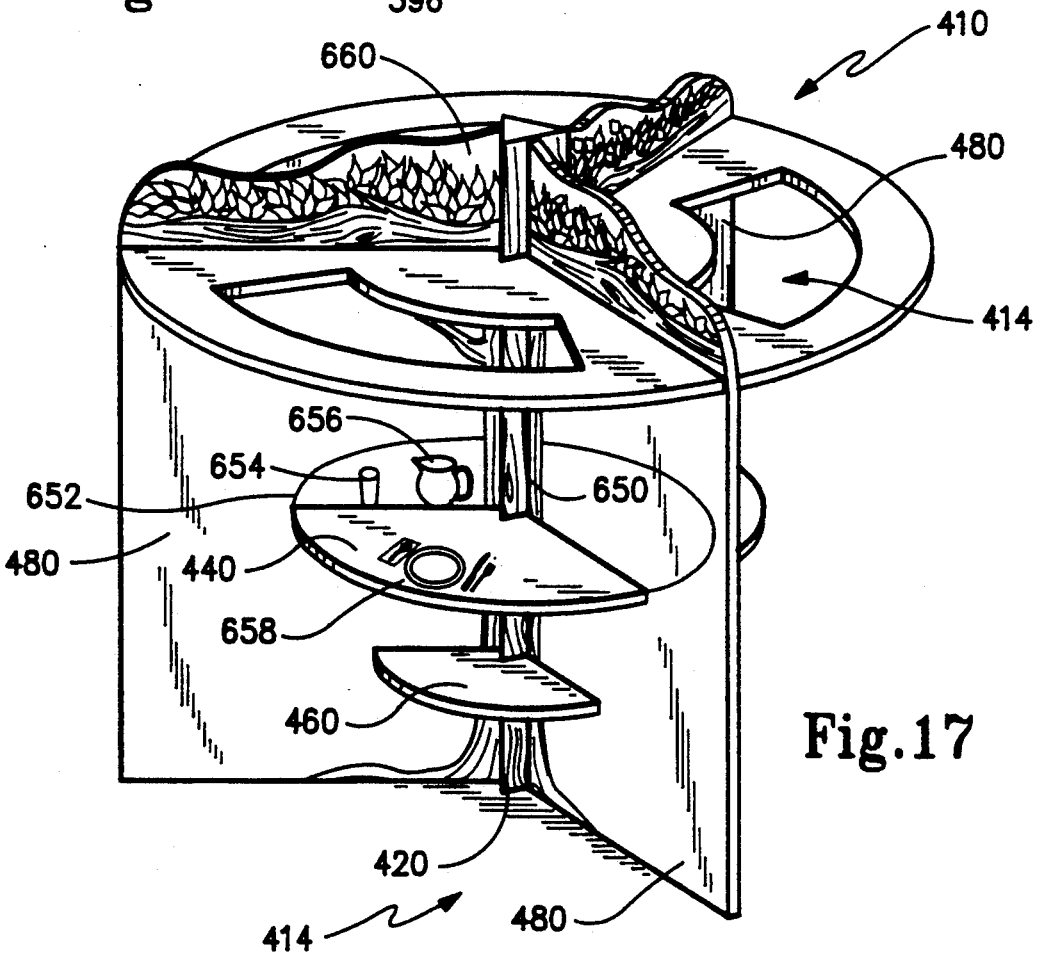
Fig.17

ACTIVITIES MODULE

FIELD OF INVENTION

The present invention generally relates to articles of furniture and specifically is directed to modular activity centers for children. The field of the present invention particularly relates to modular construction wherein structural members interlock with one another to form a unit which may be quickly assembled or disassembled. The present invention also concerns artistic decorations for children's furniture.

BACKGROUND OF THE INVENTION

In recent years, there has been a trend to create more pleasing work spaces for the activities of adults and children, alike. The structural design of furniture becomes a natural part of these work spaces. In other applications, furniture structures can themselves form the work or activity station. This application specially concerns the present invention.

As part of trend of interior design is to avoid the break-up of large spaces into separate, enclosed offices. Rather, more efficient and pleasant utilization of large spaces involves the creation of semi-private areas by means of divider panels that do not extend from floor to ceiling. This design has been found to be less psychologically confining when compared to small enclosed rooms. One example of such structures, then, is the use of modular desk systems with divider panels that are often employed in office environments as secretarial spaces, work stations, computer stations, etc. Another example is the use of divider panels or especially constructed semi-private desk units as reading/work stations in libraries and other records research facilities. These examples, of course, are by no means exhaustive.

While substantial attention has been directed to the structural design of modular facilities, less attention is believed to have been directed to providing modular activity centers for children. While there is a need in such applications to separate large, open rooms into defined activity areas, typically office-type modular units do not readily adapt to children's environments and are further often too expensive to be cost effective in many child-related situations. Additionally, while all applications of modular activity areas and work stations need to be utilitarian, there is a greater need with children to provide artistic integration into the design for purposes of stimulating a child's imagination. Also, it is an advantage in the construction of children's activity centers to provide structures which may be relatively quickly and simply assembled and disassembled whereby the modular activity structures can be knocked down and stored when it is desired to use a room in situations necessitating more openness, such as parties, meetings and the like.

SUMMARY OF THE INVENTION

It is an objection of the present invention to provide a new and useful activities module which may be positioned on a support surface and which provides one or more horizontal work surfaces and one or more divided activity areas.

It is a further objection of the present invention to provide an activities module which is relatively inexpensive in construction.

A further object of the present invention is to provide an activities module of simplified construction which may be readily assembled and disassemble with a minimum of time and effort.

Still a further object of the present invention is to provide an activities module which is particularly suitable as a work station for children.

Another object of the present invention is to provide structures wherein artistic designs may be integrated on vertical and horizontal surfaces thereof.

Yet a further object of the present invention is to provide an activities module that provides a plurality of work stations having desk-like surfaces and which provides at least one separate area that can be used, for example, for storage of objects.

According to the present invention, then, an activities module is provided and is adapted to be positioned on a support surface, such as the floor of a room. The activities module includes an upright post member which has at least two grooves formed therein so that, when the post member is oriented in an upright position, the grooves extend generally in a vertical direction. A first flat panel has an opening sized to receive the upright post member and forms a work surface for the activity module. A plurality of partition panels support the flat panel member and have a bottom edge operative to engage the support surface on which the activities module is placed. Each partition panel is oriented perpendicularly with respect to the flat panel and has a tongue structure on an inner edge that is operative to matably engage a respective groove in the upright post member. Slots are provided to allow engagement of the partition panels with the first panel member and fasteners secure each partition panel with respect to the post member. The partition panels are fastened with respect to the post member to thereby form at least one divided activity area between the divider panels.

Preferably, two flat panel members are provided and may be of similar geometric construction with one panel being smaller than the other. The smaller flat panel may be placed between the larger flat panel and the support surface to provide an under shelf for the storage of objects. In either case, as desired, a notch maybe provided in the periphery of the flat panels, and the partition panels may be provided with slots that extend from an inner edge partially toward their outer edge. The partition panels may be then mounted so that their slots receive the flat panels with the notches on the flat panels engaging a portion of each partition panel adjacent its slot to prevent relative rotation of the flat panels when assembled. Further, the grooves in the upright post may be channels that extend substantially the full length thereof so that the tongue structure associated with each partition panel is provided by a margin of the partition panel adjacent the inner edge thereof. Additional flat panels may be provided as shelves, benches and the like. The partition panels may form different activities areas and the module may be constructed so that the additional flat panels are located in an activities area different than the first and/or second panel members.

While the center post could be circular, it is preferred to be polygonal in cross-section and, for example, may be square-shaped in cross-section. The polygonal shape again helps prevent relative rotation of the flat panel member. Where at least three partition panels are provided, they may be equiangularly spaced around the upright post member. Screw-type fasteners can be used to extend transversely across each groove to engage and fasten the partition panel tongues therein.

If desired, a roof structure may be supported by the upright post member and the partition panels so that it is located above the flat panel members. Artistic elements may be formed on one of the the vertical surfaces of a divider panels and additionally artistic elements may be formed on the first flat panel member in a manner such that the first flat panel forms a horizontal structural representation that is integrated into a common theme with the artistic elements.

These and other objects of the present invention will become more readily appreciated and understood from a consideration of the following detailed description of the preferred embodiment when taken together with the accompanying drawings, in which:

BRIEF DESCRIPTION OF THE DRAWINGS

FIG. 13 is a top plan view of a first support panel used with the third exemplary embodiment shown in FIGS. 11 and 12;

FIG. 16 is a top plan view of a third support panel used with the fourth exemplary embodiment shown in FIGS. 14 and 15;

FIG. 17 is a perspective view of a fifth exemplary embodiment of the activities module according to the present invention, again showing artistic elements integrated therein;

DETAILED DESCRIPTION OF THE EXEMPLARY EMBODIMENTS

The present invention concerns the structure of activity modules which can be employed in a work or activity space to provide distinct activity stations for human activity. These activity stations, for example, provide work areas having work surfaces and storage areas having structure for storing objects. However, it should be understood from the outset, that the partitioned activity stations may be provided with customized structure for any particular application while including the underlying structure described and claimed herein.

The present invention also describes and claims new and useful decoration for articles of furniture. For this purpose, an "article of furniture" includes not only free-standing activity modules such as described in the exemplary embodiments of the present invention, but also free-standing furniture or wall mounted furniture where a wall comprises an upright support member for the furniture application. As described below, the artistic elements for this decoration integrate vertically depicted artwork and horizontally depicted artwork integrated with one another and with one or more of the horizontal support surfaces providing an artistic element that is also integrated into the artistic theme of the decoration.

Figure 1:
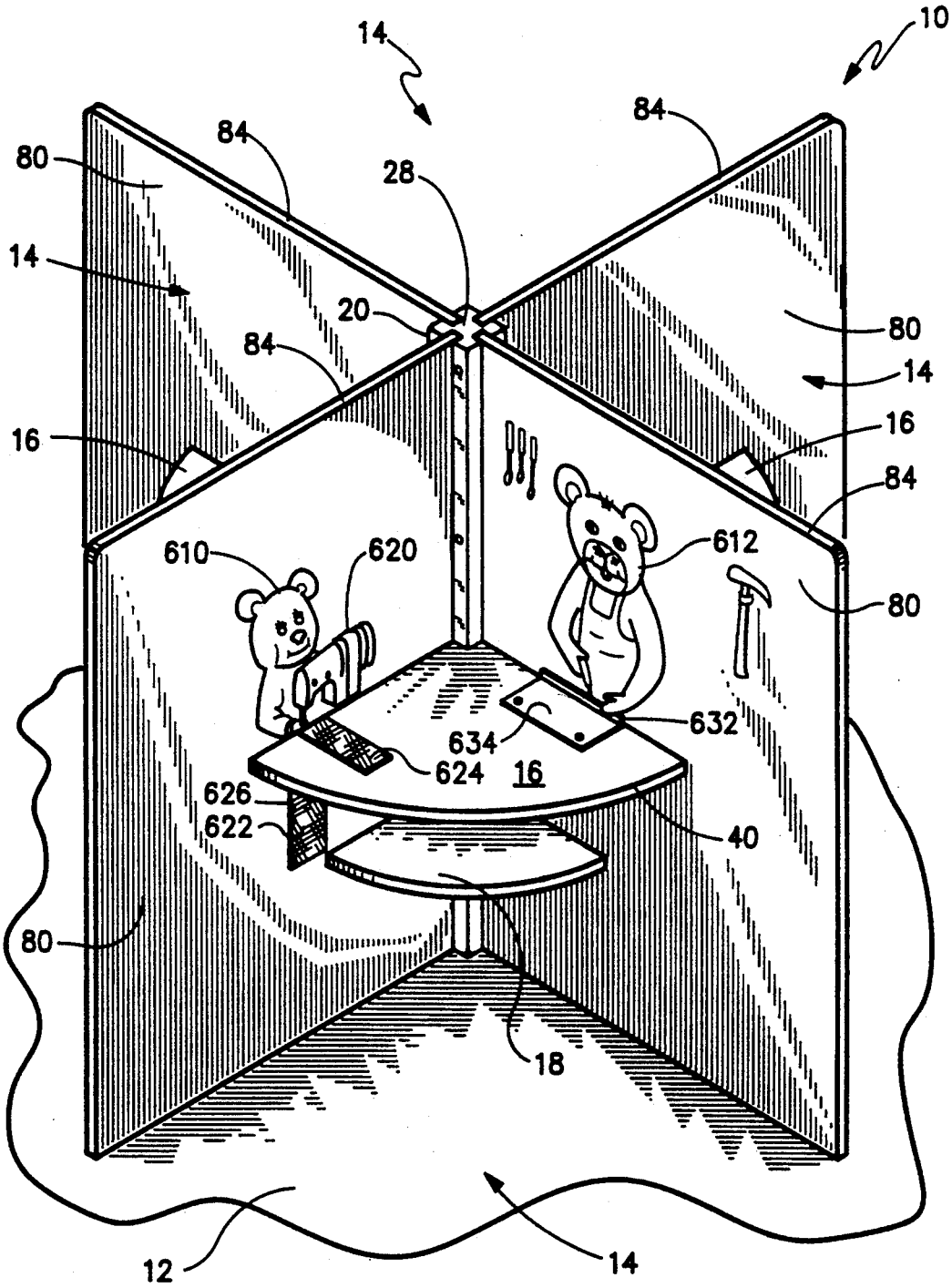
FIG. 1 is a perspective view of the activities model according to a first exemplary embodiment of the present invention showing four work stations as well as artistic elements according to the present invention.
Figure 2:
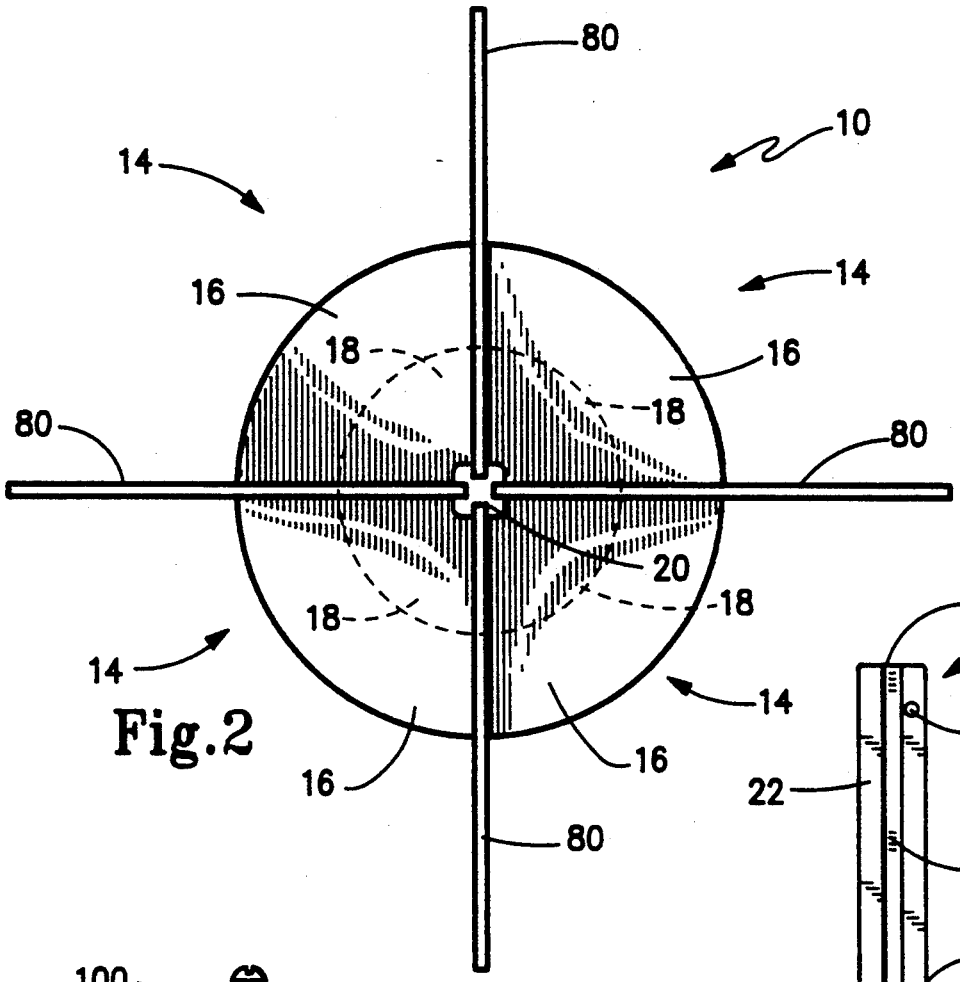
FIG. 2 is a top plan view of the structure (without any artwork) of the activities module shown in FIG. 1.

A first exemplary embodiment of the present invention is shown in FIGS. 1 and 2; the structural forming members used to produce this embodiment are then shown in FIGS. 3–7. Turning to FIGS. 1 and 2, however, an activities module 10 is shown and is supported on a support surface 14 which will typically be the floor of a room which houses the activities module. Activities module 10 partitions a portion of that room into a plurality of activity stations 14, and the embodiment of activities module 10 shown in FIGS. 1 and 2 provides four such activity stations 14. Each activity station 14 is formed by a space between partition panels 80, and each includes a desk-like work surface 16 and lower shelf surfaces 18, one of which is shown in FIG. 1 and the remainder of which are shown in phantom in FIG. 2. Artistic elements provide decoration in the are shown in FIG. 1, and a discussion of these decorative elements is described more thoroughly below.

Figure 4:
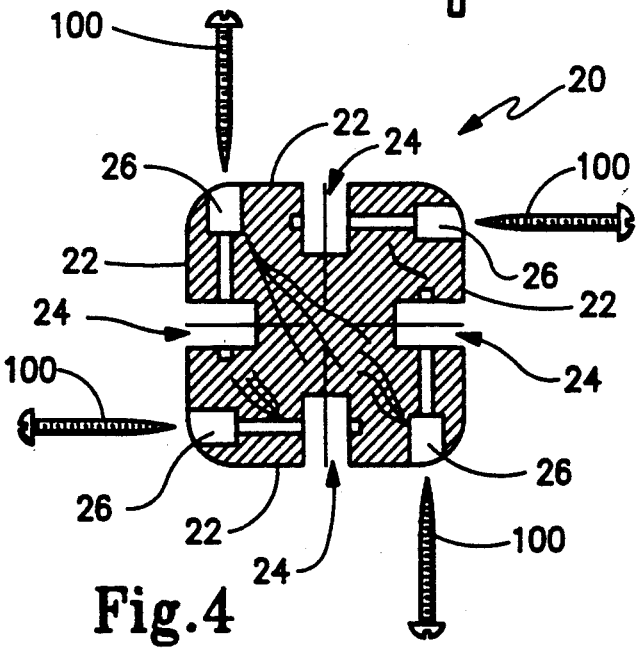
FIG. 4 is a cross-sectional view taken about line 4—4 of FIG. 3 and showing screw fasteners used in the exemplary embodiment of the present invention.
Figure 3:
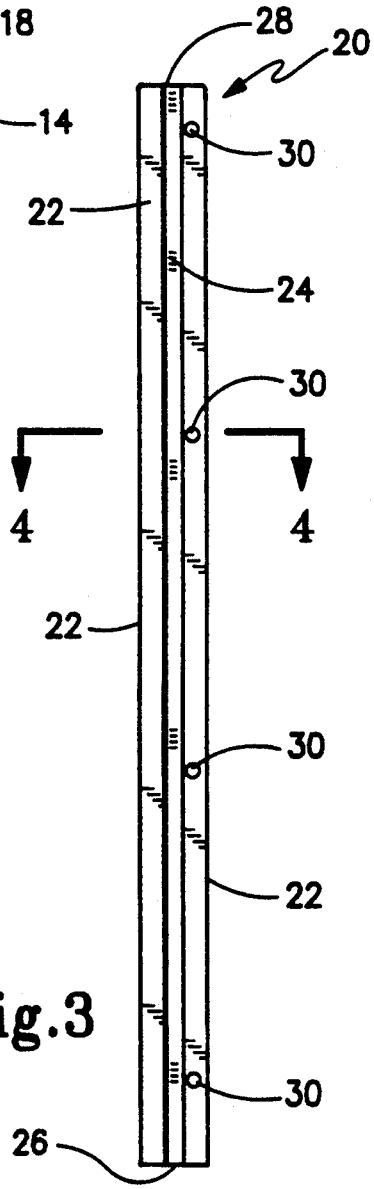
FIG. 3 is a side view in elevation showing an upright post member used to construct the activities module of FIGS. 1 and 2.

As mentioned above, the structural members which are used to produce activities module 10 are shown in FIGS. 3–7. With reference, then, to FIG. 4 an upright post member 20 is provided in the form of a member of square-shaped cross-section having rounded corners so as to eliminate any sharp edges. Post member 20 is preferably formed out of wood, but other structural materials may also be used. Post member 20 further has a plurality of grooves 24 formed in sides 22 thereof with each groove 24 extending as a channel for the complete length of post member 20, in this exemplary embodiment. Post member 20 has a lower end 26 and an upper end 28. While it is not essential that post 20 extend the entire height of activities module 10, in this embodiment it does so, as is shown in FIG. 1. Thus, lower end 26 engages support surface 12 while upper end 28 terminates at upper edges 84 of each partition panel 80. Again, as described more thoroughly below, post member 20 has a plurality of countersunk bores 30 formed in a side wall 22 and so that fasteners can extend across a groove 24 in an adjacent side 22 to provide means for assembly activities module 10.

Figure 5:
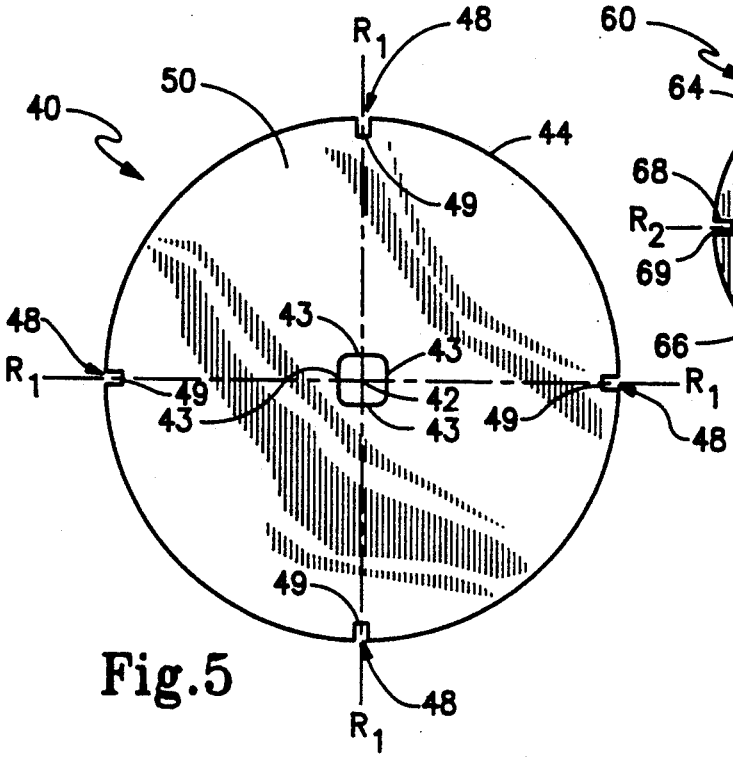
FIG. 5 is a top plan view of a first flat panel member used in constructing the activities module of FIGS. 1 and 2.
Figure 6:
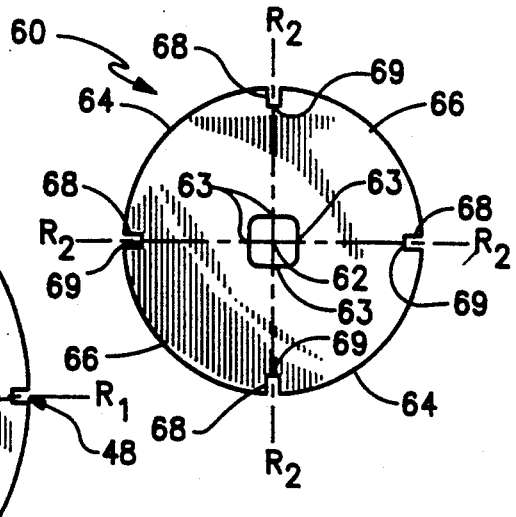
FIG. 6 is a top plan view of a second flat panel member used to construct the activities module of FIGS. 1 and 2.
Figure 7:
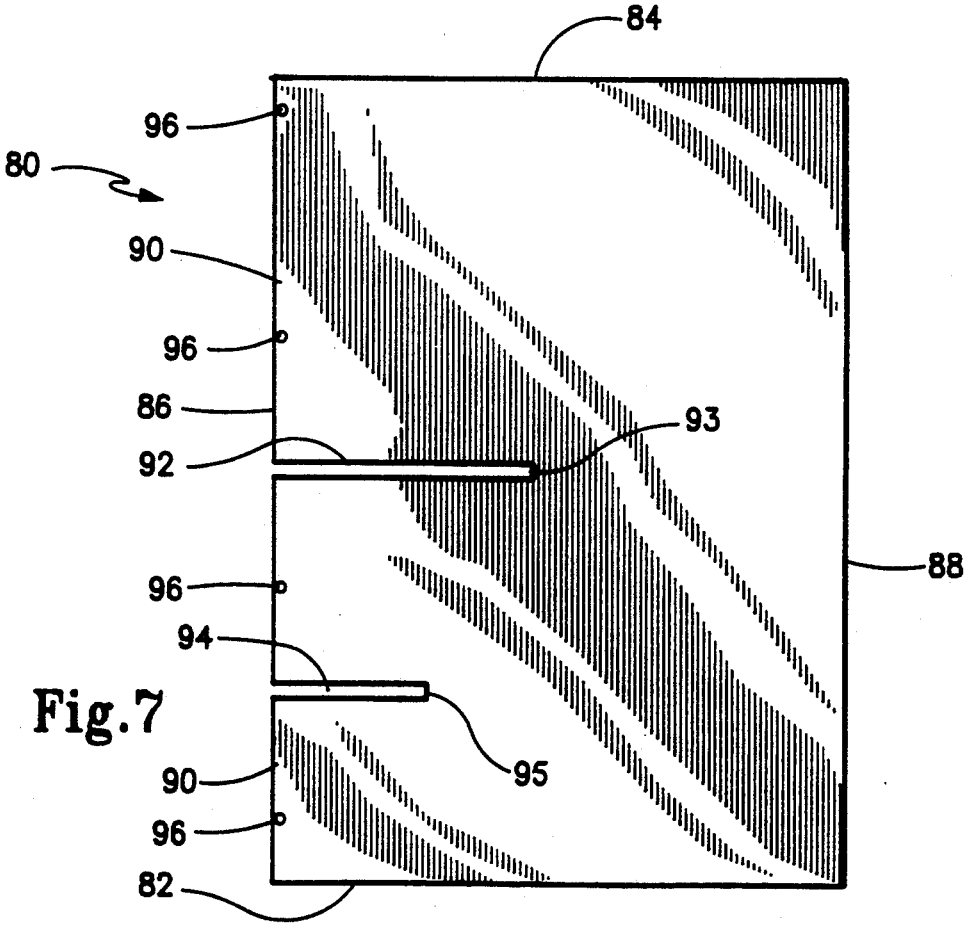
FIG. 7 is a side view in elevation of a partition panel used to construct the activities module of FIGS. 1 and 2.

First and second flat panel members 40 and 60 are respectively shown in FIGS. 5 and 6 and respectively provide work surfaces 16 and shelf surfaces 18 shown in FIGS. 1 and 2. As may be seen in FIG. 5, first flat panel member 40 is circular in shape and has a central square shaped opening 42 sized for close-fitted engagement with post member 20. Panel member 40 has a peripheral edge 44 and is provided with a plurality of notches 48 cut into the margin 46 thereof in a direction along planes $R_1$ are perpendicular to edges 43 of opening 42. Panel member 40 is preferably constructed of a composite material, such as a pressed wood composition of a selected thickness. Panel member 40 further has an upper surface 50 which provides each of work surfaces 16 (FIGS. 1 and 2) and a lower surface opposite upper surface 50.

Second flat panel member 60 has a shape that is geometrically similar to the shape of panel member 40, but second flat panel member 60 is smaller in diameter than panel member 40. Thus, as shown in FIG. 6, panel member 60 has a central opening 62 which is square-shaped with edges 63 so that it is sized to receive square post 20 in close fitted engagement. Panel member 60 has a peripheral edge 64 opposite opening 62 with peripheral edge 64 being circular in shape. A plurality of notches 68 are cut into margin 66 of panel member 60 and are oriented in planes $R_2$ which are perpendicular to edges 63 of opening 62. Panel member 60 is also constructed of a suitable composition material, such as a pressed wood, having a selected thickness. Panel member 60 further has an upper surface 70 which provides shelf surfaces 18 (FIGS. 1 and 2) and a lower surface opposite upper surface 70.

A plurality of partition panels 80 are provided for activities module 10, and, in this embodiment, four such panels 80 are shown. A representative partition panel 80 is accordingly depicted in FIG. 7 where it may be seen that panel 80 has a lower edge 82, an upper edge 84, and inner edge 86 and an outer edge 88 opposite inner edge 86. Partition panel 80 is constructed of a composite material, such as pressed wood, of a selected thickness sized so that a margin 90 of partition panel 80 which is adjacent inner edge 86 provides a tongue means sized for mated with a respective groove 24 in post member 20. A first slot 92 extends from inner edge 86 towards outer edge 88 a portion of the distance thereacross. Slot 92 is parallel to lower edge 82 of partition panel 80. Similarly, a second slot 94 extends from inner edge 86 toward outer edge 88 for a portion of the distance thereacross but which distance is less than the length of slot 92. Slot 94 is parallel to lower edge 82 so that first and second slots 92 and 94 are parallel to one another. A plurality of holes 96 extend through partition member 80 in margin 90 and are positioned so as to align with bores 30 of upright post member 20 when margin 90 matably engages groove 24. The length of slot 92 should be equal to the sum of the distance between edge 43 of opening 42 and the base 49 of notch 48 plus the depth of margin 90 which engages groove 24. Similarly, the length of slot 94 should be equal to the sum of the distance between edge 63 of opening 62 and base 69 of notch 68 plus the depth of margin 90 which again mates with groove 24.

From the above description, the assembly of activities module 10 may now be more readily appreciated. First flat panel members 40 and 60 are positioned so that openings 42 and 62 are actually aligned with one another, and post 20 is slid into openings 42 and 62. Panels 40 and 60 are then separated a distance equal to the distance between slots 92 and 94 so that partition panels 80 may be advanced radially towards openings 42 and 62 with slots 92 and 94 respectively receiving flat panel members 40 and 60 therein. Panel members 80 are each positioned that a respective margin 90 may be inserted into a respective groove 24 in post member 20. When this is done, the portions of panels 80 adjacent the ends 93 and 95 of slots 92 and 94 respectively engage notches 48 and 68. Thus, partitions 80 are equiangularly spaced around post 20 and are prevented from relative rotation by notches 48 and 68. When margins 90 engage grooves 24, holes 96 align with countersunk bores 30 and partitions 80 may be fastened to posts 20 by means of a plurality of screw fasteners such as bolts 100 shown in FIG. 4. It may thus be appreciated that activities module 10 may be easily assembled and disassembled with a total of sixteen bolts 100, in the embodiment shown in FIG. 1–7. Naturally, other means of fastening the activities module 10 together may be used as would be understood by the ordinarily skilled person in this field.

Before discussing the additional embodiments described in this invention, it is appropriate to set forth some of the preferred dimensions of the structural members described above. As noted, the preferred material for flat panel members 40 and 60 as well as partition panel 80 is a pressed wood, the dimensions of these pieces have been selected to minimize scrap and to decrease manufacturing steps when activities module 10 are produced. This naturally reduces the cost of the unit. To this end, it should be recognized that pressed board sheet standardly come in a dimension of 4' by 8', and the preferred thickness selected for all of these panels is ¾". Each of partition panels 80 is square-shaped and is selected to be 4' by 4' so that a pair of partition members 80 can be formed by simply cutting a standard sheet of material into two square-shaped pieces after which slots 92 and 94 may be simply cut and bores 96 provided in margin 90. With this construction, slots 92 are cut mid-way between lower edge 82 and upper edge 92 and slots 94 are cut half-way between slots 92 and lower edge 82. Slot 92 has a length of 23" while slot 94 has a length of 19".

Since partition panels 80 define the height for activities module 10, it should be appreciated that this height is 4', which is particularly suitable for children's environments. To this end, therefore, a pair of posts 20 may be cut from a standard 8' length of 4" by 4" wood so that each post 20 will have a vertical height that is the same as the vertical height of each partition panel 80. Grooves 24 and bores 30 may be cut into each post section and appropriate hardware provided for bores 30, as desired, to mate with fasteners 100. Grooves 24 are preferably cut to have a width of 13/16".

Each flat panel 40 is selected to have a diameter of 4' so that a pair of circular panels 40 may be cut from a 4' by 8' piece of pressed wood, with minimal scrap. Flat panel members 60 are selected to be 40" in diameter to provide suitable shelf space, even though this does generate some scrap in manufacture. Each of notches 48 and 68 have a width of ¾".

Figure 8:
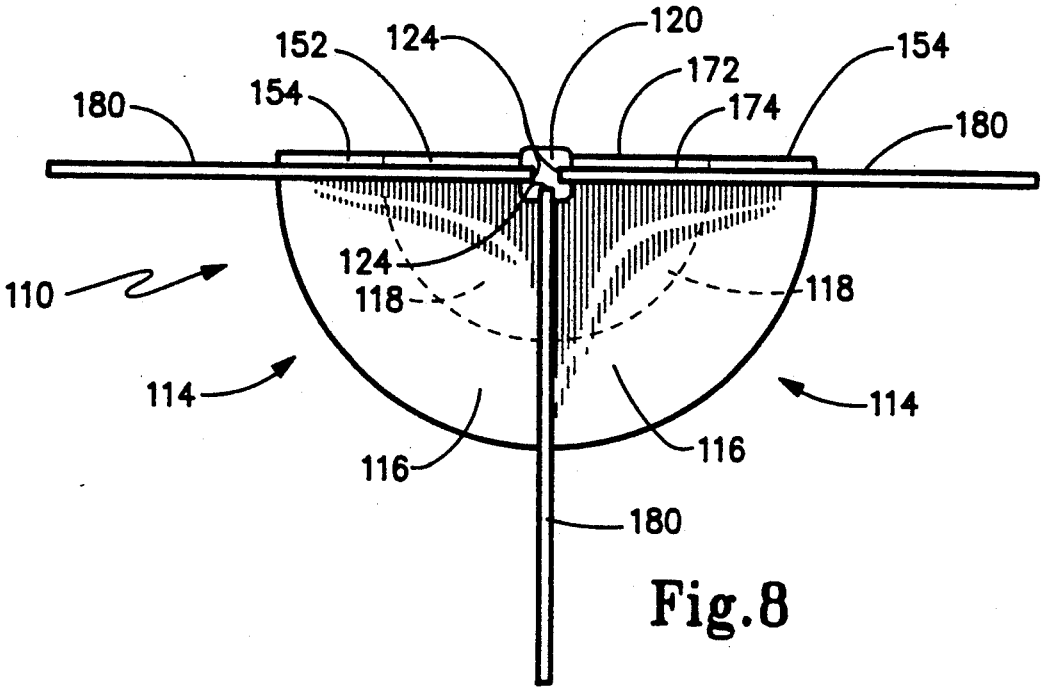
FIG. 8 is a top plan view of a second exemplary embodiment of the present invention.
Figure 9:
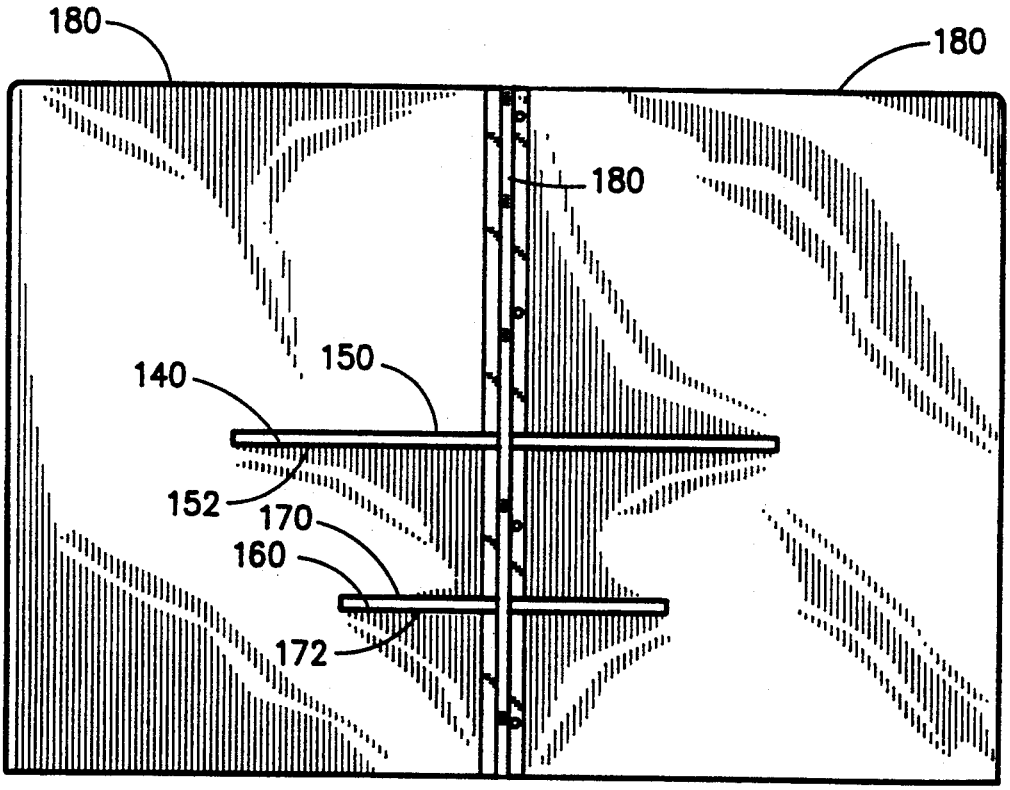
FIG. 9 is a side view in elevation showing the activities module of FIG. 8.
Figure 10:
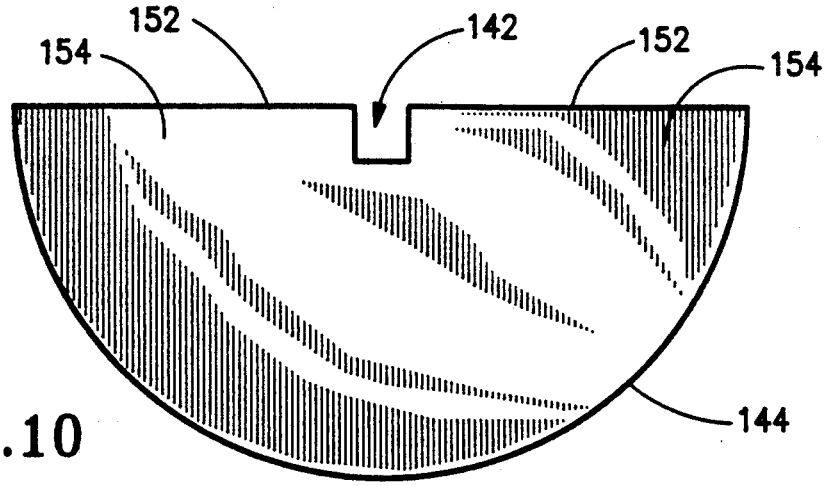
FIG. 10 is a top plan view of a first support panel used with the second exemplary embodiment shown in FIGS. 8 and 9.

While the above described embodiment provides a highly useful activities module which is especially suitable to provide work stations, such as separate desks or table surfaces that are free standing, it is often desirable to have other configurations of activities areas which can be formed according to the present invention without departing from the concepts of this invention. Accordingly, a second exemplary embodiment of the present invention is shown in FIGS. 8–10. Here, activities module 110 provides two activity stations 114 between partition panels 180. Two of partition panels 180 are oriented in a common vertical plane while the other partition panel 180 is oriented perpendicularly to this plane. Upright post 124 is provided with three grooves 124, and semi-circular first and second flat panels 140 and 160 are provided to create work surfaces 116 and shelf surfaces 118, respectively. To this end, as shown in FIG. 9, first panel member 140 has an upper surface 150 which forms work surface 116 and a lower surface 152 opposite upper surface 150. Similarly, panel 160 has an upper surface 170 providing shelf surface 118 and a lower surface 172 opposite surface 170.

From a manufacturing standpoint, it may be desired to use an upright post 120 that is identical to post 20 so that is would have an extra groove merely as a "decorative groove". Also, it is preferred in this structure to include a wing portion such as wing portions 154 and 174 along the edges 152 and 172, respectively, of flat panel members 140 and 150 so that these portions extend completely through the respective slots on partition panels 180 an unobtrusive distance. This allows for the complete formation of the respective notches in the flat panel members to engage partition panels 180. Further, it should be appreciated that, while activities module 110 is free standing, it may readily be oriented adjacent a room wall. As is shown, then, in FIG. 10, first flat panel member 140 has an opening 142 formed therein through edge 152. Opening 142 is sized to receive upright post 120. A similar opening (not shown) is provided for second flat member 160.

Figure 11:
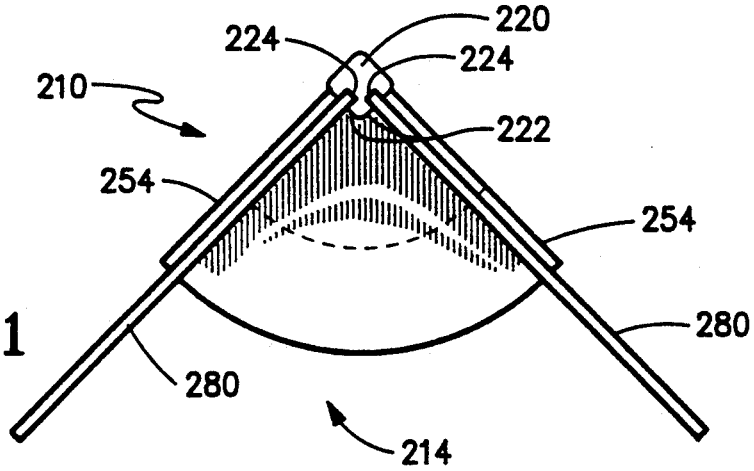
FIG. 11 is a top plan view of a third exemplary embodiment of the activities module according to the present invention.
Figure 12:
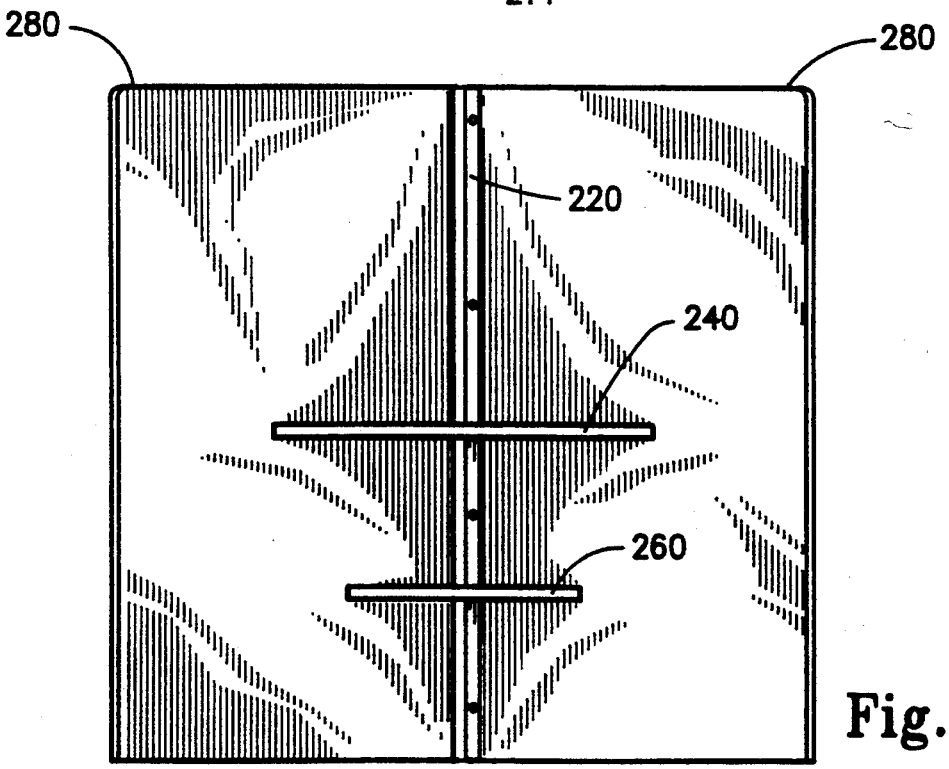
FIG. 12 is a side view in elevation of the activities module of FIG. 11.

A third exemplary embodiment of the present invention is shown in FIGS. 11–13. Here, activities module 210 provides a single activity station 214 between a pair of partition panels 280 which are oriented at right angles with respect to one another. Partition panels 280 are structured identically with partition panels 80 and are mounted in a post 220 that has a pair of grooves 224 formed on adjacent sides 222 thereof. First and second flat panel members 240 and 260 are again provided, with each of these panels being ¼ circular panels. As shown in FIG. 13, representative first flat panel 240 has an opening 242 formed therein to receive post 220. Again wings, such as wings 254, may extend through the respective slots and partitions 280.

Figure 14:
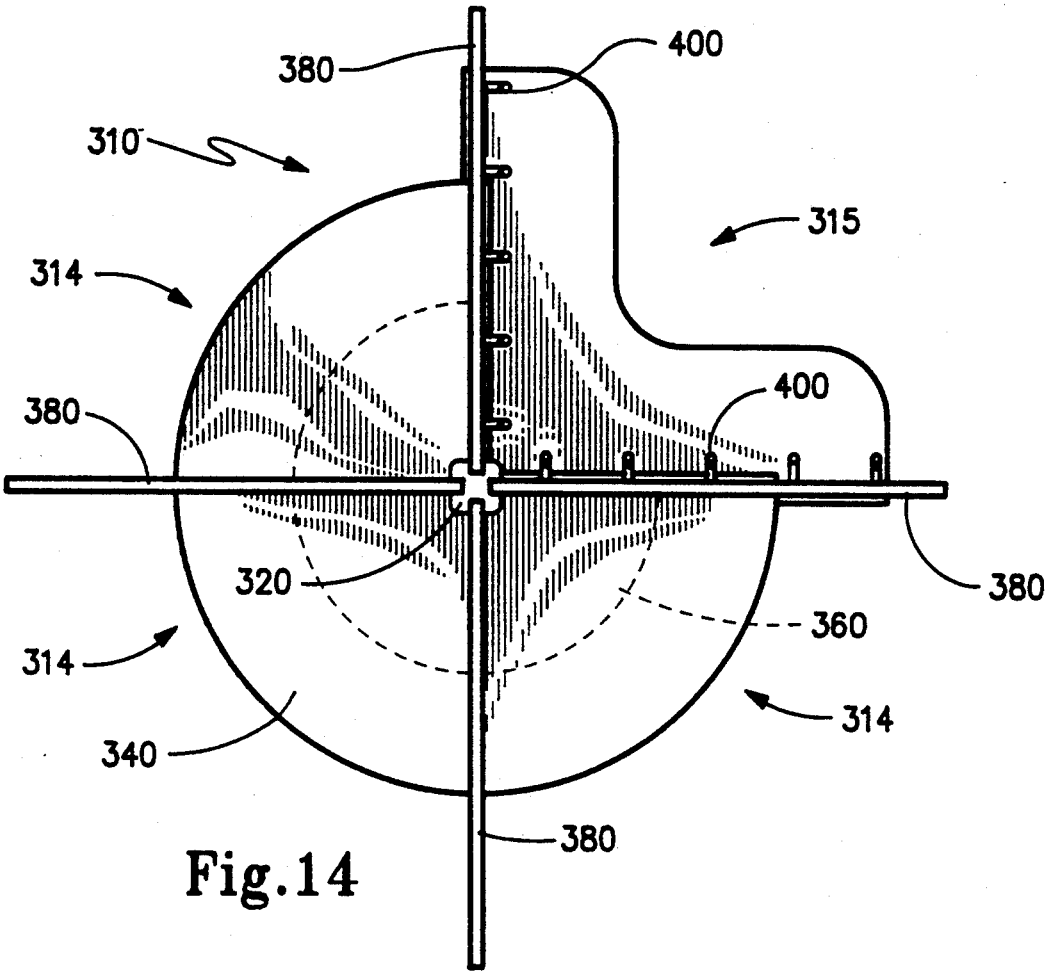
FIG. 14 is a top plan view of a fourth exemplary embodiment of the activities module according to the present invention.
Figure 15:
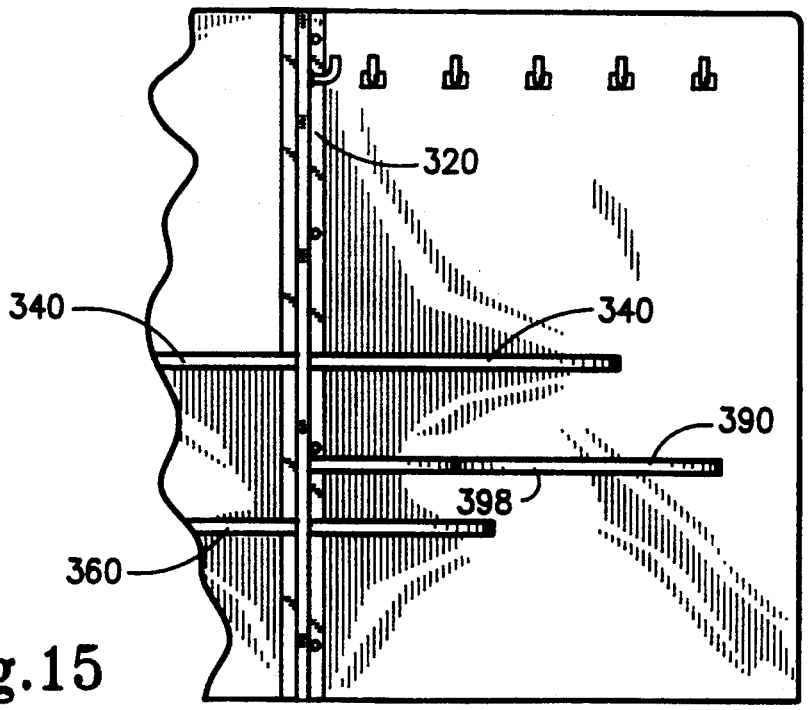
FIG. 15 is a side view in elevation showing a portion of the activities module of FIG. 12.

Yet another embodiment of the present invention is shown in FIGS. 14–16. Here, activities module 310 provides four activity stations including three work stations 314 and a bench and for storage activity station 315. Four partition panels 380 are used with an upright post 320 that is identical to upright post 20 described in the first exemplary embodiment. First and second flat panel members 340 and 360 are again provided and are ¾ circular panels. The embodiment shown in FIGS. 14–16 includes a shelf-like panel 390 which is positioned in activity station 315 that is partitioned from work stations 314. Shelf-like panel 390 is positioned to provide a bench for station 315 at a suitable height where children may sit. As is shown in FIG. 16, panel 390 includes an opening 392 to receive post 320 and is generally L-shaped in configuration. A pair of slots 394 are formed in and parallel to perpendicular edges 396 and are sized to receive a corresponding slot 398 formed in the respective partition panels 380. The dimension of third slot 398 and slots 394 should be readily apparent to the ordinarily skilled person based on the foregoing teachings with respect to slots 92 and 94 as well as notches 48 and 68.

Coat hooks 400 are also provided and are mounted in activity station 315 on the respective partition panels 380. This provides storage for objects such as hats, coats, sweaters, etc. However, it should be fully appreciated that activity station 315 may be used for other applications than as a bench or coat storage. For example, a plurality of panels similar to shelf-like panel 390 could be vertically spaced along partition walls 380 to provide a bookshelf in station 315. Storage cabinets of various sizes and configurations could also be placed in station 315.

Figure 18:
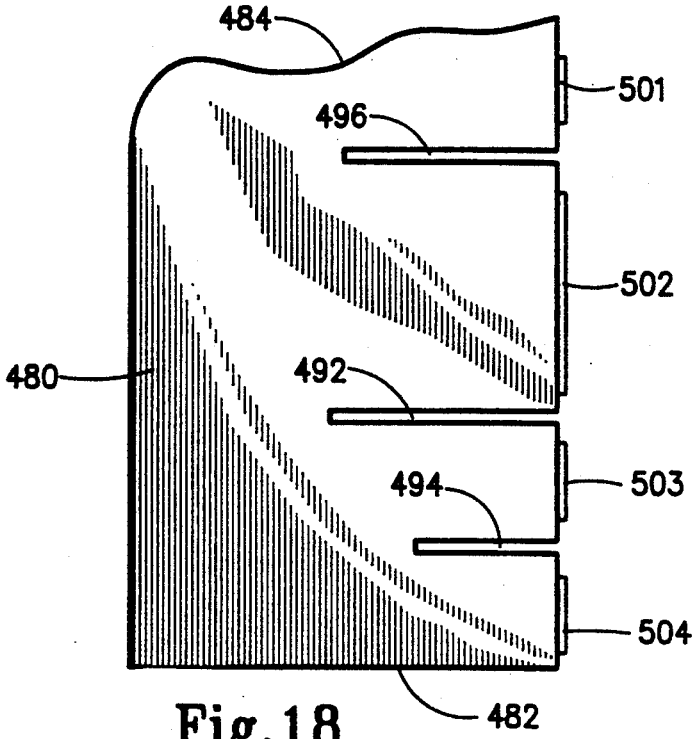
FIG. 18 is a side view in elevation of a partition panel used with the exemplary embodiment shown in FIG. 17.
Figure 19:
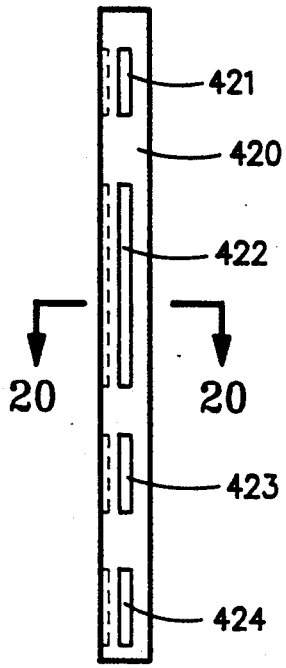
FIG. 19 is a side view in elevation of an upright post member used in the exemplary embodiment of FIG. 17.

A final exemplary embodiment of the present invention is shown in FIGS. 17–21. Here, activity module 410 provide three activity stations 414 which are formed by three partition panels 480 equiangularly spaced around an upright post member 420. Several different features and constructions are shown in FIGS. 17–21 and are described below. First, it should be appreciated that upright post 420, shown in FIGS. 18 and 19, is triangular in cross-section and is provided with a plurality of grooves 421, 422, 423 and 424 rather than a single channel that extends the entire length of post 420.

Figure 20:
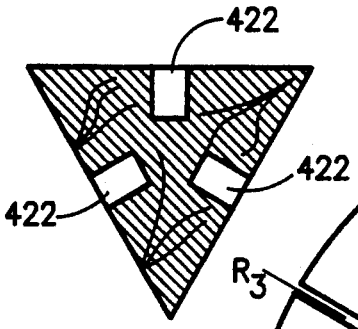
FIG. 20 is a cross-sectional view taken about lines 20—20 of FIG. 16.
Figure 21:
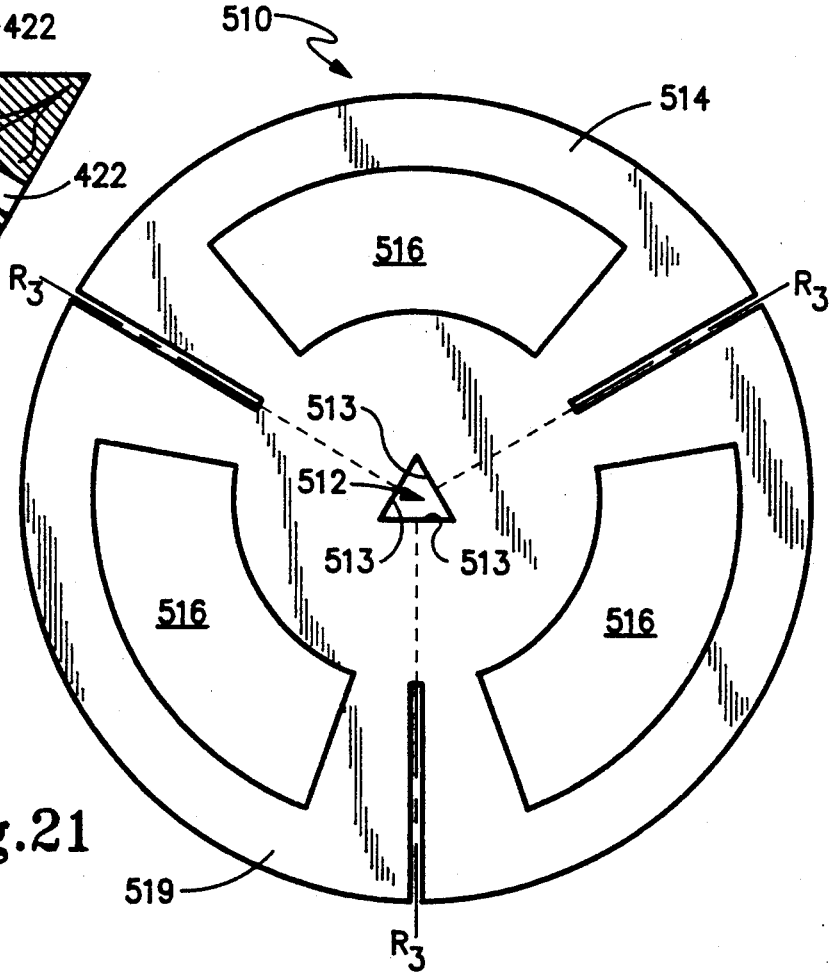
FIG. 21 is a bottom plan view of a roof panel used in the activities module shown in FIG. 14, including artistic elements incorporated thereon.

Each partition member 420, as shown in FIG. 20, is similarly constructed to partition panels 80, but each has a greater vertical height as measured between lower edge 482 and upper edge 484. Inner edge 486 is provided with a plurality of tongues 591, 592, 593 and 594 which respectively engage grooves 421–424 of post 420. Slots 492 and 494 are the same as slots 92 and 94 and receive first and second flat panels 440 and 460. However, it should be appreciated that the respective openings in panels 440 and 460 are triangular in configuration as opposed to the square-shaped configuration in FIGS. 5 and 6. An additional slot 496 is provided, proximate upper edge 484 to receive a roof structure panel which is best shown in FIG. 21. Here, roof panel member 510 has a circular shape and has a triangular opening 512 sized to receive post 420. Panel member 520 has a peripheral edge 514. A plurality of openings 516 are provided to emit light through the roof structure of activities module 410. Three equiangularly spaced slots 518 extend inwardly from perimeter edge 514 and are perpendicular to edges 513 of opening 512, along radial planes are $R_3$. FIG. 17 shows roof panel member 510 received in a mounted condition in the respective slots 496 of partition panels 480 so that it provides a roof structure over activity stations 414.

Activities module 410 might be particularly suited for outdoor environments or constructed of materials which would be resistant to the elements. Such applications could include eating facilities, shade facilities, etc. If desired, openings 516 could include translucent panels that would emit light but provide some protection against direct sunlight.

As noted at the beginning of this specification, the present invention also includes the use of specially integrated artistic elements to create integrated decoration for articles of furniture such as the activities modules of the present invention. Representative examples of this artwork are best shown in FIGS. 1 and 17 where it may be seen that the upright support members in the form of respective partitions panels 80 and 480 have first artistic elements formed thereon. For example, in FIG. 1, two "bear-like" FIGS. 610 and 612 are shown working on various projects. Bear 610 appears to be sewing on a sewing machine 620 which appears to be supported by first flat panel 40. Artistic decoration representing a piece of material 622 having a portion 624 artistically formed, such as by painting, on horizontal support panel 40 and with a portion 626 painted on vertical support panel in the form of partition 80 is provided so that the "material 622" appears to "hang" from support panel 40. Similarly, bear 612 appears to working with tools on a workpiece 632. A portion of workpiece 632 is painted on partition member 80 and a another portion 634 is painted on horizontal support member 40. Thus, the illusion is again then created that support panel 40 is supporting work piece 632 so that the horizontal support member forms a horizontal structural representation integrated into the common artistic theme. Additional tools are artistically represented on partition panel 80.

With respect to FIG. 17, partition panels 480 are painted with appears to be the trunk and branches of a tree 650, and panels 480 are further painted to appear to have an extension of horizontal support panel 440. thus, table 652 appears surrounds the trunk of tree 650 with a portion of this table actually being panel 440. A pitcher 656 and a glass 655 are painted on a partition 480 so that it appears that they are supported by support panel 440, and support panel 440 is painted with tableware setting 658 in the form of a plate, knife, spoon, fork, and napkin. An upper portion of support panels 480 are painted in the form of leaves 660 that is supported by the trunk of tree 650 and, if desired, the lower surface 519 of roof member 510 could be painted with foliage so as to appear to be supported by tree 650.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An activities module adapted to be positioned on a support surface and operative to provide at least one horizontal work surface and at least one activity station comprising:

(a) an upright post member having at least two grooves formed therein such that, when said upright post member is oriented in an upright position, the grooves extend in a vertical direction;

(b) a first flat panel member of a selected thickness and having a first opening sized to receive said upright post member, said first flat panel member being oriented horizontally with respect to said upright post member when said upright post member is in the upright position with the first opening engaging said upright post member, said first flat panel member having an upper surface forming a horizontal work surface for the activities module, a peripheral edge opposite said first opening and a peripheral margin adjacent the peripheral edge;

(c) a plurality of upright partition panels each having a bottom edge operative to engage the support surface, an outer edge and an inner edge opposite said outer edge, each said partition panel being oriented perpendicularly with respect to said first flat panel member and having tongue means on the inner edge thereof for matably engaging a respective one of said grooves in said post member;

(d) first slot means for permitting engagement of said partition panels and said first panel member; and (e) fastening means for securing each of said partition panels with respect to said post member whereby at least one divided activity area is formed between said partition panels.

2. An activities module according to claim 1 wherein said first slot means includes a first partition panel slot formed in each of said partition panels, each said first partition panel slot extending from said inner edge toward said outer edge of a respective partition panel and having a width sized to receive the thickness of said first panel member.

3. An activities module according to claim 2 wherein the width of each said first partition panel slot is sized for close-fitted engagement with said first panel member.

4. An activities module according to claim 2 wherein said first slot means includes a plurality of panel slots formed in said first panel member, said panel slots sized and positioned for close-fitted engagement with said partition panels.

5. An activities module according to claim 4 wherein said panel slots are formed as notches in the peripheral margin of said first panel member.

6. An activities module according to claim 1 including a second flat panel member of a selected thickness and having a second opening sized to receive said upright post member, said second flat panel member being oriented horizontally with respect to said upright post member when said upright post member is in the upright position with the second opening engaging said upright support member, said second flat panel member having an upper surface forming a horizontal work surface for the activities module, a peripheral edge opposite said second opening and a peripheral margin adjacent the peripheral edge, and including second slot means for permitting engagement of said partition panels and said second panel member.

7. An activities module according to claim 6 wherein said second flat panel member has a similar geometry as said first flat panel member in a horizontal plane.

8. An activities module according to claim 6 including a third flat panel member of a selected thickness and having a third opening sized to receive said upright post member, said third flat panel member being oriented horizontally with respect to said upright post member when said upright post member is in the upright position with the third opening engaging said upright support member, said third flat panel member having an upper surface forming a horizontal work surface for the activities module, and including third slot means for permitting engagement of said partition panels and said third panel member.

9. An activities module according to claim 8 wherein said third flat panel member provides a bench for the activities module, said third flat panel member being located in an activities area of said activities module that is different from said first flat panel member.

10. An activities module according to claim 8 wherein said third flat panel member provides a shelf for the activities module.

11. An activities module according to claim 1 wherein said tongues are each formed by an inner margin of each said partition panels adjacent the inner edge thereof.

12. An activities module according to claim 11 wherein said upright post has a selected length, each of said grooves extending the length of said upright post.

13. An activities module according to claim 1 wherein said partition panels are oriented at an angle of less than 180 degrees with respect to one another.

14. An activities module according to claim 1 including at least three of said partition panels.

15. An activities module according to claim 14 wherein said partition panels are equiangularly spaced around said upright post member.

16. An activities module according to claim 14 wherein two of said partition panels are oriented in a common plane and wherein a third one of said partition panels is perpendicular to the common plane.

17. An activities module according to claim 1 wherein said fastening means includes a plurality of threaded fasteners mountable transversely across said grooves to engage and fasten said tongues therein.

18. An activities module according to claim 1 including a roof structure supported by said upright post member and said partition panels above said first flat panel member.

19. An activities module according to claim 1 including first and second artistic elements, said first artistic elements being formed on at least one of said partition panels and said second artistic elements being formed on said first flat panel member, said first flat panel forming a horizontal structural representation integrated into a common theme with said first and second artistic elements.

20. An activities module adapted to be positioned on a support surface and operative to provide at least one horizontal work surface and at least one partition activity station comprising:

(a) an elongated upright post member having a square-shaped cross section and having at least two grooves formed therein such that, when said upright post member is oriented in an upright position, the grooves extend in a vertical direction;

(b) a first flat panel member of a selected first thickness and having a first opening sized to receive said upright post member, said first flat panel member being oriented horizontally with respect to said upright post member when said upright post member is in the upright position with the first opening engaging said upright post member, said first flat panel member having an upper surface forming a horizontal work surface for the activities module, a first peripheral edge opposite said first opening and a first peripheral margin adjacent the first peripheral edge;

(c) a second flat panel member of a selected second thickness and having a second opening sized to receive said upright post member, said second flat panel member being oriented horizontally with respect to said upright post member when said upright post member is int he upright position with the second opening engaging said upright post member, said second flat panel member having an upper surface forming a horizontal work surface for the activities module, a second peripheral edge opposite said second opening and a second peripheral margin adjacent the second peripheral edge;

(d) a plurality of upright partition panels each having a bottom edge operative to engage the support surface, an outer edge and an inner edge opposite said outer edge, each said partition panel being oriented perpendicularly with respect to said first flat panel member and having tongue means on the inner edge thereof for matably engaging a respective one of said grooves in said post member, each of said partition panels having first and second slots formed therein form said inner edge thereof toward the outer edge thereof, each of said first and second slots sized for close-fitted engagement respectively with said first and second flat panel members, adjacent ones of said partition panels being angularly oriented to one another around said upright post at angles that are integral multiples of 90 degrees; and (e) fastening means for securing each of said partition panels with respect to said post member whereby at least one activity station is formed between said partition panels.

21. An activities module according to claim 19 wherein said first and second panel members are each provided with notches formed in the first and second peripheral edges thereof and operative to engage said partition panels to support said partition panels against relative rotation.

22. An activities module according to claim 19 including at least three of said partition panels.

23. An activities module according to claim 22 wherein said partition panels are equiangularly spaced around said upright post member.

* * * * *